US005682648A

United States Patent [19]

Miller

[11] Patent Number: 5,682,648

[45] Date of Patent: Nov. 4, 1997

[54] FLOWER ATTACHMENT MECHANISM FOR CLOTHING

[76] Inventor: Marilyn Miller, 5422 Shawnee, Sierra Vista, Ariz. 85635

[21] Appl. No.: 695,580

[22] Filed: Aug. 12, 1996

[51] Int. Cl.[6] ..... A45F 5/08; A44C 1/00

[52] U.S. Cl. ..... 24/5; 24/303; 248/206.5; 63/29.2

[58] Field of Search ..... 24/5, 66.1, 303; 63/29.2, 1.1, 2; 248/27.8, 206.5; 40/1.5

[56] References Cited

U.S. PATENT DOCUMENTS

| | | | |
|---|---|---|---|
| 2,173,011 | 9/1939 | Meester | 24/5 |
| 2,507,559 | 5/1950 | D'Andrea | 248/206.5 X |
| 2,659,169 | 11/1953 | Brennan | 63/29.2 X |
| 3,073,063 | 1/1963 | Schumm | 24/5 X |
| 3,159,372 | 12/1964 | McIntosh | 248/206.5 X |
| 3,309,258 | 3/1967 | Gallo | 24/5 X |
| 3,416,195 | 12/1968 | Borthwick | 24/5 |
| 3,982,303 | 9/1976 | Shulkin | 24/6 |
| 4,559,675 | 12/1985 | Devenny | 24/5 |
| 4,912,944 | 4/1990 | Crosley et al. | 63/29.2 |
| 5,347,733 | 9/1994 | Whittington | 24/303 X |
| 5,349,725 | 9/1994 | Levy | 24/303 |
| 5,392,497 | 2/1995 | Defner | 24/303 |
| 5,450,658 | 9/1995 | Hichs | 24/303 |
| 5,473,799 | 12/1995 | Aoki | 24/303 |

FOREIGN PATENT DOCUMENTS

| | | | |
|---|---|---|---|
| 2945712 | 5/1981 | Germany | 63/29.2 |

*Primary Examiner*—Peter M. Cuomo
*Assistant Examiner*—Robert J. Sandy

[57] ABSTRACT

An improved mechanism for holding ornaments such as flowers onto clothing. The mechanism uses a cradle to secure the flowers or other ornamentation onto the clothing. In the preferred embodiment, the cradle/holder partially encircles the flower stems and has prongs which are inserted into the stems. The cradle/holder is preferably metallic and is placed on an exterior portion of the clothing while a magnet is placed on an opposing location on an interior portion of the clothing. The magnetic attraction between the holder and the magnet are sufficient to firmly secure the flower arrangement to the clothing without having to damage the clothing by either piercing (e.g. a needle) or pinching (e.g. a clasp) the clothing.

15 Claims, 2 Drawing Sheets

FLOWER ATTACHMENT MECHANISM FOR CLOTHING

BACKGROUND

This invention relates generally to flowers and more particularly to the fastening of flowers to clothing.

It is a basic nature of people to add variation and personalized touches to their clothing. This is especially true for special occasions such as weddings, parties, dining out, and a host of other occasions when more elaborate clothing is used.

The accessories which are often used in such occasions are broaches and flowers, with flowers being especially popular. The problem arises when the flowers are to be attached or secured to this fine clothing.

Traditionally, the flower arrangement is secured to the clothing using a standard straight pin. While the straight pin does little damage to the clothing, if used frequently, this damage becomes much more apparent.

Further, the straight pin has a sharp end which often pricks the wearer or their partner. This can cause slight bleeding which will stain or damage fine clothing.

Even further, the straight pin approach is sometimes difficult to apply to certain dresses.

Broaches suffer from the same problems as they are often attached using a pin/clasp arrangement which can easily damage the clothing. In some rare applications, some broaches include a clamping mechanism which grips a fold of the clothing to obtain attachment.

The damage is only exasperated if either the broach or the flower arrangement is increased in weight. Since the pin is supported by only a few fibers in the clothing where the pin rests, these fibers tend to stretch and deform.

It is clear from the foregoing that there is a need for a mechanism to secure flowers and other ornamental items to clothing.

SUMMARY OF THE INVENTION

The invention involves an improved mechanism for holding ornaments such as flowers onto clothing. In the discussion herein, the ornamental item is an arrangement of flowers, but, the invention is not to be so limited and includes other means of ornamentation obvious to those of ordinary skill in the art.

The mechanism uses a holder including a cradle to secure the flowers or other ornamentation onto the clothing. The cradle is designed to be secured to the flowers. Often the flowers come pre-arranged and wrapped in a paper to help maintain the arrangement; in this application, the holder/cradle slips over the stems of the flowers.

In other applications, the holder/cradle is adapted to assist in the arranging of the flowers. For this application, the flowers are put into the selected position and the holder/cradle is crimped to be used to maintain the flowers in their arranged positions.

In the preferred embodiment, the cradle/holder partially encircles the flower stems and has prongs which are inserted into the stems. The prongs are arranged on winged portions which extend from vertical walls. The winged portions are structured so that once the flower stems have been inserted into the cradle of the holder, the wings are crimped against the flower stems so that the prongs pierce the stems and form a bonding between the holder and the flower stems so that the two are now integrated into a single unit.

The cradle/holder is preferably metallic and is placed on an exterior portion of the clothing while a magnet is placed on an opposing location on an interior portion of the clothing. In some embodiments, the back surface of the holder is "roughened" to provide minute prongs which give additional frictional connection between the holder and the fabric.

The magnetic attraction between the holder and the magnet are sufficient to firmly secure the flower arrangement to the clothing without having to damage the clothing by either piercing (e.g. a needle) or pinching (e.g. a clasp) the clothing.

Although the preferred embodiment uses a metallic holder with a magnet on the interior portion, a variety of other arrangements are also available. These include the magnetizing of the holder and the use of a metallic ring on the inside; or both the holder and the internal plate are magnetized so that opposite magnetic poles are used to secure the two components to the clothing.

While the use of metal for the holder and the magnetic plate are preferred, other materials are obvious to those skilled in the art including the use of doped plastics or other magnetic materials.

The invention, together with various embodiments thereof, will be more fully explained by the attached drawings and the following descriptions.

DRAWINGS IN BRIEF

DRAWINGS IN DETAIL

Figure 1A:
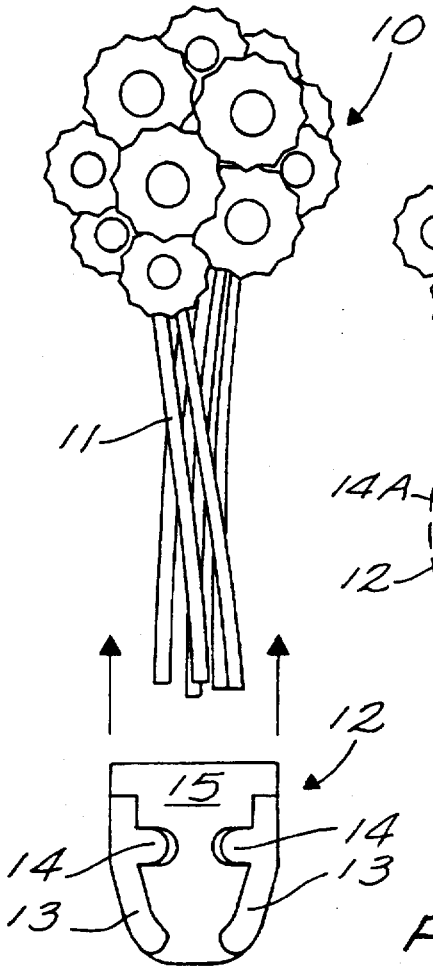
FIGS. 1A and 1B are front and top views of the preferred embodiment prior to application to a flower arrangement.
Figure 1B:
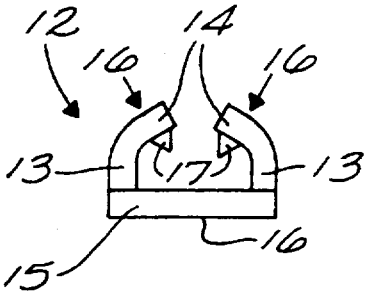

FIGS. 1A and 1B are front and top views of the preferred embodiment prior to application to a flower arrangement.

Flowers 10 have stems 11 extending therefrom. Holder 12 is positioned to receive stems 11.

Holder or clasp 12 creates a cradle for stems 11. This cradle consists of base plate 15, side walls 13, and wings 14. When the stems 11 are inserted therein, stems 11 are substantially encircled. Note, in this embodiment, side walls 13 are angled towards each other to form a V shape. This conforms to the natural narrowing of stems 11.

After insertion of stems 11 into holder 12, wings 14 are crimped inward as shown by arrows 18 to force prongs 17 to engage with stems 11. This provides a secure mechanism to affix holder 12 to stems 11.

In one embodiment of the invention, an exterior surface 16 of base plate 15 is roughened to provide additional frictional attachment to the garment when the holder is secured to the garment.

The cradle is preferably metallic and has a substantially flat posterior surface illustrated in this view as exterior surface 16.

Figure 2A:
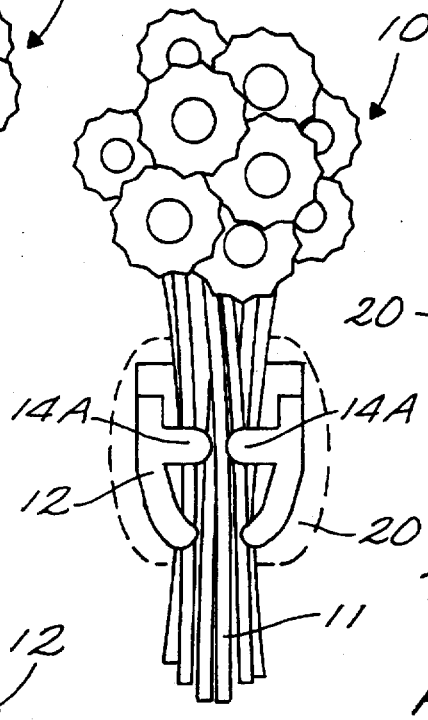
FIGS. 2A and 2B are front and top view of the preferred embodiment after application and attachment to a flower arrangement.
Figure 2B:
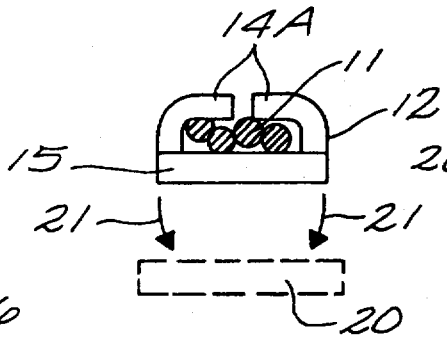

FIGS. 2A and 2B are front and top view of the preferred embodiment after application and attachment to a flower arrangement.

As discussed with relationship to FIG. 1, wings 14A have been crimped inward to force the prongs (not visible in this view) into stems 11. This secures holder 12 to flowers 10.

Holder 12 in this embodiment is metallic and is naturally attracted to magnet 20, as shown by arrows 21. In this embodiment of the invention, magnet 20 is circular in shape. This shape is ideal since it doesn't present any sharp corners to either damage the garment or to irritate the wearer.

While the present discussion describes the use of a magnetized plate 20 and a holder 12, the invention contemplates a variety of materials and magnetic properties. In an alternative embodiment, holder 12 is magnetized and plate 20 is not; in still another alternative embodiment, both holder 12 and plate 20 are magnetized.

Further, the materials used for holder 12 and plate 20 are varied to include any material which exhibits magnetic properties.

Figure 3A:
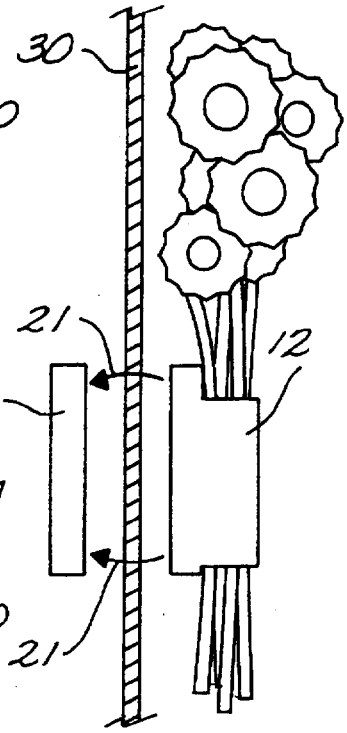
FIGS. 3A and 3B are side views illustrating the securement of the preferred embodiment to an article of clothing.
Figure 3B:
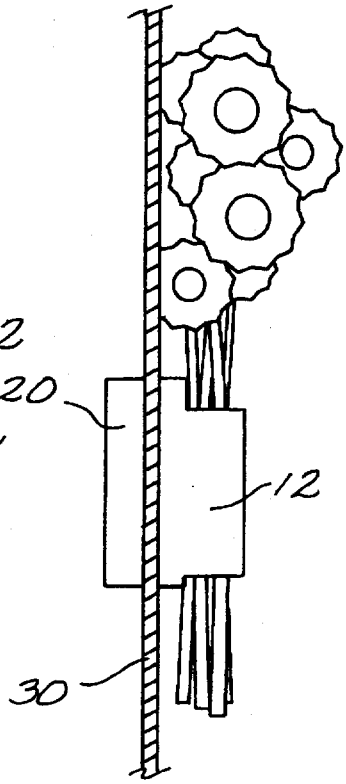

FIGS. 3A and 3B are side views illustrating the securement of the preferred embodiment to an article of clothing.

Magnetized plate 20 is positioned within garment 30 with the holder 12 on an opposing side. The natural magnetic attraction between the magnet and the metal is shown by arrows 21. This magnetic pull 21 creates a "sandwich" around the clothing 30 so that holder 12 is properly maintained in the chosen position.

Figure 4:
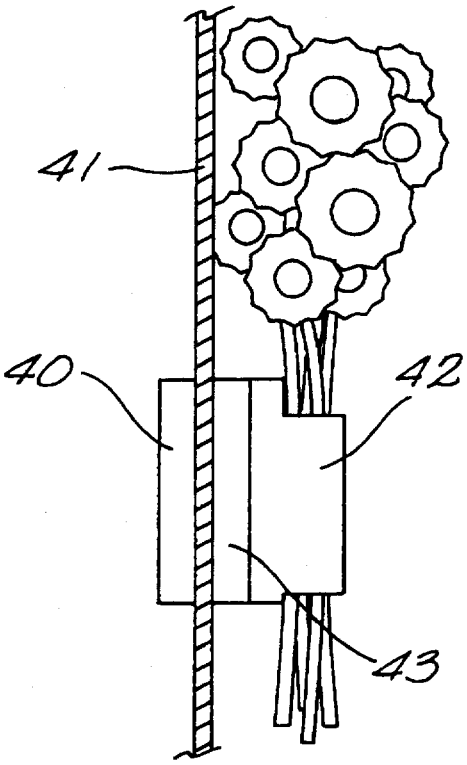
FIG. 4 is a side view of an alternative embodiment of the invention.

FIG. 4 is a side view of an alternative embodiment of the invention.

While the preferred embodiment uses a magnetized plate within the garment and a metallic holder, other embodiments are also contemplated.

In some applications, the use of a single magnet is not sufficient to fully secure the ornamental material. In this situation, the use of two magnets provides for even further adhesion.

Magnetic plate 40 is positioned on one side of garment 41 with an opposing magnetic plate 43 on the exterior side. With the magnetic poles positioned opposite between magnetic plate 40 and magnetic plate 43, an extremely strong attraction is formed.

Magnetic plate 43 is also used to secure holder 42 and its attendant flower arrangement.

This embodiment is useful where the flower arrangement is particularly large and heavy or where garment 41 provides minimal frictional properties to secure the assembly in a fixed position.

Figure 5:
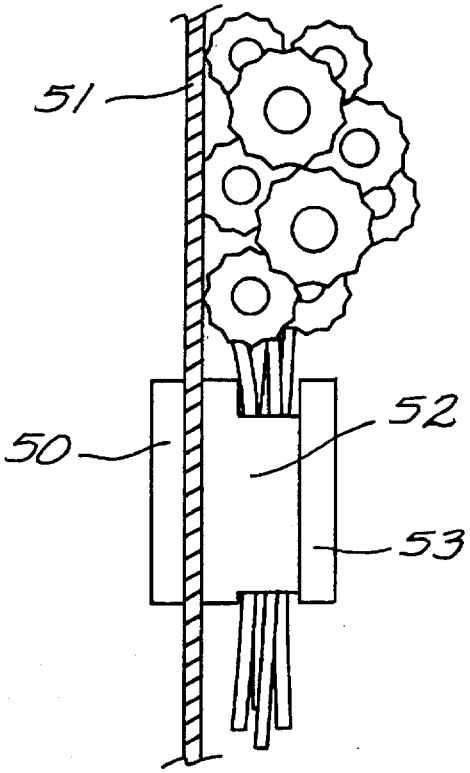
FIG. 5 is a side view of a second alternative embodiment of the invention.

FIG. 5 is a side view of a second alternative embodiment of the invention.

Again, in this embodiment, additionally force is required to secure holder 52 to garment 51. In this embodiment, magnetic plate 50 is positioned on an interior portion and magnetic plate 53 is attached to a portion of holder 52. The magnetism from magnetic plate 53 is communicated through metallic holder 52 and provides additional attraction and holding power.

Figure 6:
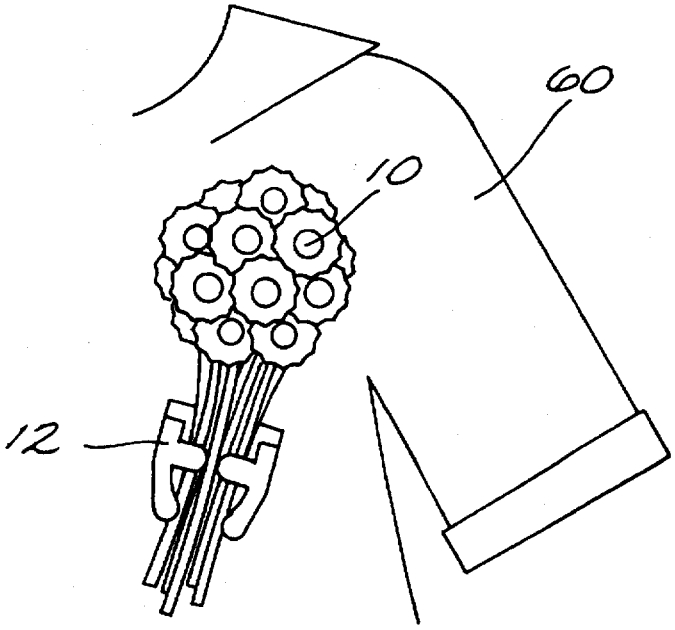
FIG. 6 is a frontal view of the invention holding a flower arrangement to a blouse.

FIG. 6 is a frontal view of the invention holding a flower arrangement to a blouse.

Flower arrangement 10 is secured to blouse 60 using holder 12 (as described before) and a plate (not shown) within blouse 60. In this manner, the flower arrangement is securely attached to blouse 60 without causing any damage to the garment.

It is clear that the present invention creates a highly improved attachment mechanism for a variety of ornamental articles.

What is claimed is:

1. A fastening mechanism for securing flowers to clothing, comprising:

a) a metallic holder securable to stems of a flower arrangement via a cradle having a posterior portion and a first wall member and a second wall member extending substantially perpendicular to said posterior portion, said first wall member and said second wall member adapted to conform to the stems of said flower arrangement, said metallic holder having a substantially flat posterior surface, said metallic holder postionable on an exterior surface of an article of clothing; and, b) a magnet, postionable on an interior surface of the article clothing such that magnetic forces from said magnet secures said metallic holder to said article of clothing.

2. The fastening mechanism according to claim 1 wherein said first wall member further includes a first wing member and said second wall member further includes a second wing member, said first wing member and said second wing member extending towards each other from their respective wall members.

3. The fastening mechanism according to claim 2 wherein said first wing member and said second wing member each include at least one prong adapted to be inserted into the stems of said flower arrangement when said first wing member and said second wing member are crimped against said stems.

4. The fastening mechanism according to claim 1 wherein said metallic holder is magnetized.

5. The fastening mechanism according to claim 4 further including a second magnet in contact with said metallic holder.

6. The fastening mechanism according to claim 1 further including a second magnet secured to said metallic holder between said metallic holder and said exterior surface of the article of clothing.

7. A mechanism to secure an ornamental object to clothing, comprising:

a) a clasp securable to said ornamental object and postionable on an exterior portion of an article of clothing, said clasp including, 1) a substantially flat posterior surface, and, 2) a cradle member attached to said substantially flat posterior surface and having:

A) a first wall member being substantially perpendicular to and attached to said posterior surface, B) a second wall member being substantially perpendicular to and attached to said posterior surfacer C) a first wing member attached to said first wall member, and, D) a second wing member attached to said second wall member, said first wing member and said second wing member extending towards each other from their respective wall members; and, b) a plate postionable on an opposing interior portion of said article of clothing, said plate and said clasp adapted to exert magnetic attraction therebetween.

8. The mechanism according to claim 7 wherein said plate exerts a magnetic field and said clasp is metallic.

9. The mechanism according to claim 7 wherein said clasp exerts a magnetic field and said plate is metallic.

10. The mechanism according to claim 9 wherein said plate exerts a magnetic fields.

11. The mechanism according to claim 7 wherein said first wing member and said second wing member each include at least one prong adapted to be inserted into said ornamental object.

12. A fastener for securing an ornamental article to clothing, comprising:

a) a metallic holder securable to said ornamental article, said metallic holder having a substantially flat posterior surface and a cradle including a first wall member and a second wall member extending substantially perpendicular to a posterior portion, said first wall member and said second wall member forming a V, said metallic holder and ornamental article positionable on an exterior surface of an article of clothing; and, b) a magnet, positionable on an interior surface of the article of clothing such that magnetic forces from said magnet secures said metallic holder to said article of clothing.

13. The fastener according to claim 12 wherein the posterior surface of said metallic holder is includes minute prongs.

14. The fastener according to claim 12 wherein said first wall member further includes a first wing member and said second wall member further includes a second wing member, said first wing member and said second wing member extending towards each other from their respective wall members.

15. The fastener according to claim 14 wherein said first wing member and said second wing member each include at least one prong adapted to be inserted into the stems of said flower arrangement when said first wing member and said second wing member are crimped against said stems.

* * * * *